United States Patent [19]

Miller et al.

[11] 4,317,475

[45] Mar. 2, 1982

[54] LIQUID FILLING AND LEVEL SENSING APPARATUS

[75] Inventors: Cardell E. Miller, Hudson, Wis.; Robert F. Folley, St. Paul; Ralph H. Larson, Bayport, both of Minn.

[73] Assignee: Nordson Corporation, Amherst, Ohio

[21] Appl. No.: 199,956

[22] Filed: Oct. 23, 1980

[51] Int. Cl.[3] ..... B65B 3/04

[52] U.S. Cl. ..... 141/95; 141/198; 141/263; 141/295; 141/302

[58] Field of Search ..... 141/1-12, 141/37-66, 129-191, 198, 192, 250-310, 346-362, 369-375, 392, DIG. 1, DIG. 2, 94, 95, 96

[56] References Cited

U.S. PATENT DOCUMENTS

| | | | |
|---|---|---|---|
| 3,589,410 | 6/1971 | Manas | 141/45 |
| 3,707,174 | 12/1972 | Lewis | 141/263 |
| 3,797,535 | 3/1974 | Kaiser | 141/46 |
| 3,905,404 | 9/1975 | Cox | 141/46 |
| 3,949,792 | 4/1976 | Ramoneda Sibidi | 141/198 |
| 4,156,444 | 5/1979 | Mette | 141/286 |
| 4,159,608 | 7/1979 | Masuda et al. | 141/179 |
| 4,159,726 | 7/1979 | Mette | 141/40 |

FOREIGN PATENT DOCUMENTS

| | | |
|---|---|---|
| 2757183 | 6/1979 | Fed. Rep. of Germany . |
| 2757331 | 7/1979 | Fed. Rep. of Germany . |
| 2803111 | 7/1979 | Fed. Rep. of Germany . |
| 2012248 | 7/1979 | United Kingdom . |
| 2012249 | 7/1979 | United Kingdom . |

OTHER PUBLICATIONS

Modern Packaging Encyclopedia & Buyers Guide, "Filling Liquids and Semiliquids", Dec. 1978, W. Kent Clarke, pp. 169-176.

*Primary Examiner*—Houston S. Bell, Jr.

*Attorney, Agent, or Firm*—Orrin M. Haugen; Thomas J. Nikolai

[57] ABSTRACT

Container filling apparatus having a novel, multi-purpose nozzle including a valve designed to control injection of a liquid or semi-liquid product into the container and a further means for evacuating any froth or foam from the container while simultaneously sensing when the level of product within the container reaches the predetermined full level. The valve comprises a hollow cylindrical body defining a chamber for receiving froth and foam and discharging same through a drain port. Passing longitudinally through this body member is a tubular piston having a product tube portion extending therefrom and dimensioned to fit through the neck of the container to be filled. The product tube has an exit port near its distal end and surrounding the product tube is a combination venting and level sensing tube. The space between the outside of the product tube and the inside of the venting/level sensing tube communicates with the froth/foam receiving chamber in the valve body. Means are provided for coupling this same clearance space to a fluidic logic controller. When a container to be filled is positioned with the coaxial tube arrangement entering the filling neck thereof, the exit port zone of the product tube is extended outwardly from the distal end of the venting/level sensing tube, thereby unblocking the exit ports allowing the liquid product to flow into the container. As froth or foam flows up the venting/level sensing tube to the drain chamber, the pressure in this tube is continuously sensed. When the product level reaches the open end of the venting/sensing tube, a sudden pressure change is detected which triggers the fluidic control unit, causing the tubular piston to be retracted, terminating the product flow.

10 Claims, 3 Drawing Figures

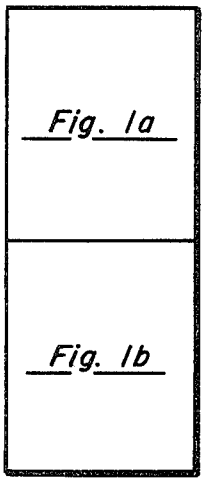
Fig. 1
Fig. 1a
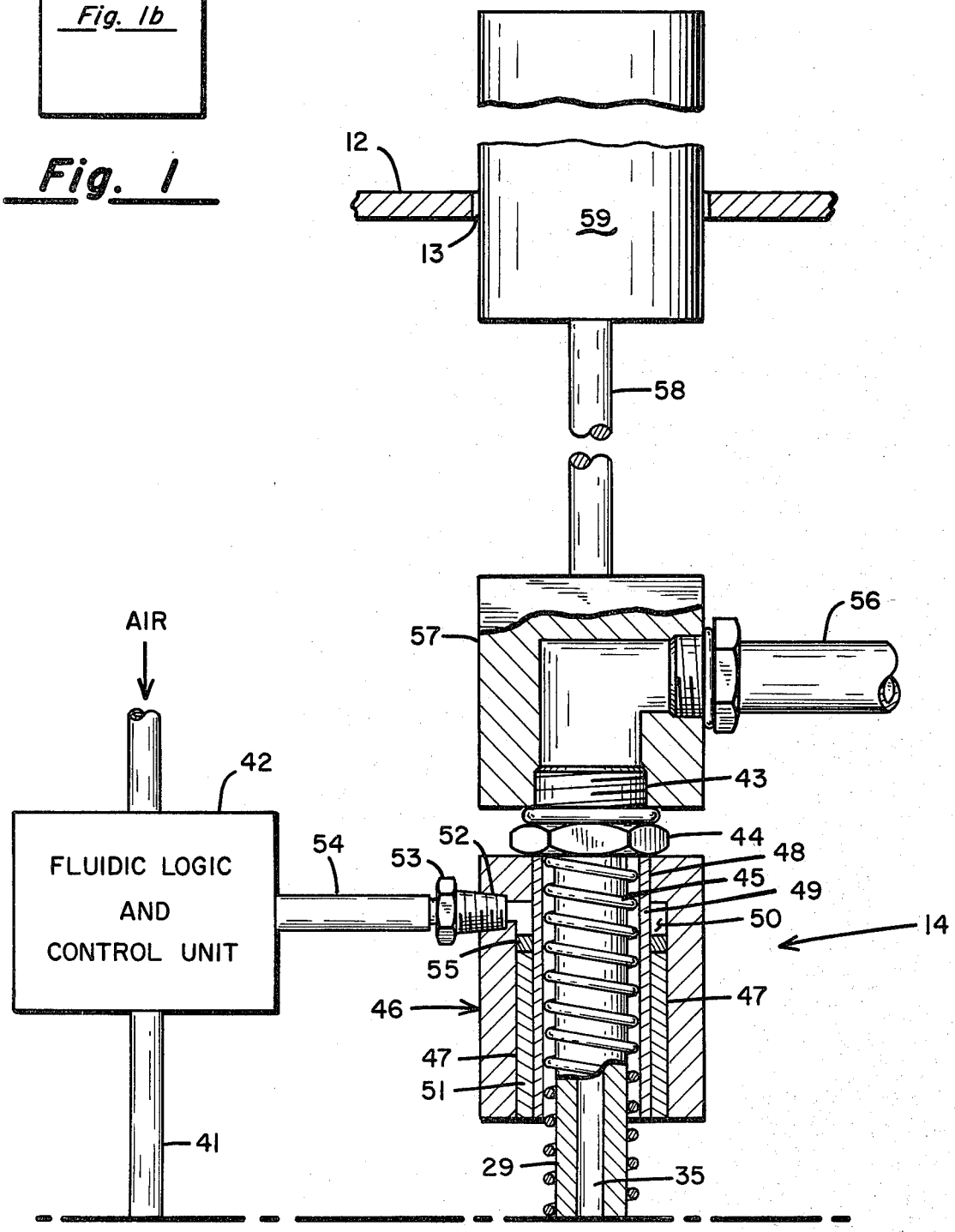

LIQUID FILLING AND LEVEL SENSING APPARATUS

BACKGROUND OF THE INVENTION

I. Field of the Invention

The present invention relates generally to container filling apparatus and more particularly to an improved, multi-purpose nozzle for use in such apparatus.

II. Discussion of the Prior Art

In most systems in which the present invention finds use, product from a supply tank is made to flow through a filling valve which typically may be opened by the presence of a container to be filled in place relative to the filling spout. The flow may be by gravity or, alternatively, pressure may be applied in the supply tank, depending upon the viscosity or flow properties of the product to be dispensed. As the product flows into the container to be filled, the air in the container is displaced either through its open top or through a vent tube when sealed filling takes place. Any froth or foam, such as may be encountered when the product being filled is a liquid soap or the like, also rises through the vent tube and may be collected for return to the supply tank. Such container filling apparatus also commonly includes a control mechanism which is capable of sensing when the product in the container reaches a predetermined level for effecting a closure of the product valve so that no more of the liquid may flow into the container.

Typical of the prior art filling apparatus is then system disclosed in the Cox U.S. Pat. No. 3,905,404. Here, a concentric arrangement of a inner pressure sensing tube and an outer product tube is coupled to a supply tank and a fluidic control unit whereby as the product being injected into the container rises to the level of the open end of the pressure sensing tube, a noticeable pressure change takes place which is sensed by the fluidic control unit which then operates to close a valve to block the flow of product through the product tube.

The Manas U.S. Pat. No. 3,589,410 also describes a related prior art system having a filling nozzle comprising a concentric arrangement of an inner product tube and an outer overflow/pressure sensing tube and incorporating the so-called "no-bottle, no-fill" feature. That is to say, before the product valve can be opened to allow a flow from the supply tank through the product tube, a container to be filled must be disposed directly beneath the filling nozzle.

The closest prior art known to applicants is represented by an earlier design to the preferred embodiment described herein which had been placed in public use by the Doboy Packaging Machinery Division of the Nordson Corporation, the assignee of the presnt invention. That earlier arrangement included a product dispensing nozzle including three concentric tubes. Specifically, the innermost tube comprised the product dispensing tube while the one adjacent to it provided the venting action whereby air and foam could be drawn from the container during the filling operation. The third and outermost outermost concentric tube was associated with a pneumatic level sensor. That earlier device was weight activated and pneumatically shut off.

In arrangements where the filling nozzle includes three concentric tubes, it is necessary for rapid filling that the lumen of the product tube be of a sufficient size so that with practical pressures and the like, a desired flow rate can be maintained. This necessitates a larger diameter venting tube and still an even greater diameter pressure sensing tube. With three concentric tubes, relatively thin wall tubing is required if the composite probe is to fit within certain container openings. Thin wall tubing, of course, may be easily damaged if rigid containers are being filled and the container opening is not perfectly centered relative to the probe. The damage may lead to jamming or erratic level sensing which, of course, is to be avoided.

SUMMARY OF THE INVENTION

In accordance with the present invention, a container filling apparatus is described in which the liquid filling and level sensing valve used therein is significantly improved over the prior art described above. Specifically, rather than incorporating three concentric tubes, namely, a product dispensing tube, an air venting tube, and a pneumatic level sensing tube, the functions performed by the venting tube and the pneumatic level sensing tube have been combined. In addition, the valve arrangement utilized herein includes the no-bottle, no-fill feature. The finish of the container to be filled is made to press up against a soft rubber seal at the base of the valve body and it is this pressure of the bottle's finish against the soft rubber gasket which causes the nozzle to open. During the entire filling operation, then, the bottle is sealed by the gasket and even the foamiest of products do not overrun to cause soiling of the container and the filling machinery. Instead, the air and foam mixture is conveyed through the lumen of the unitary venting and level sensing tube to a drain chamber in the valve body where it is collected and routed either back to the supply tank or to a disposal drain.

The fluidic control unit used in the system of the present invention injects air into the lumen of the level sensing tube at a location near its proximal end. When the level of product reaches the opening at the distal end of the composite tube, a substantial pressure change takes place which is detected by the fluidic control unit. The fluidic control unit then comes into play to trigger a pneumatic valve which introduces air under high pressure into a cylinder having a piston which coacts with the product valve to cause it to be retracted such that its exit port is closed.

By reducing the number of tubes involved in the filling and level sensing device, required maintenance is reduced in that tubes with thicker sidewalls can be used and they are less likely to be damaged in the bottling operations. All this is accomplished without a sacrifice in the precision with which the fluid level within the container can be set.

OBJECTS

It is accordingly the principal object of the present invention to provide a fluid filling machine with a novel valve arrangement whereby bottles can be rapidly filled to a precise level with the need for required maintenance being reduced.

Another object of the invention is to provide in a container filling mahine an improved filling nozzle operating on the no-bottle, no-fill principle.

A still further object of the invention is to provide a filling nozzle for a container filling machine in which only two concentric tubes provide the filling, venting and pressure sensing function.

These and other objects and advantages of the invention will become apparent to those skilled in the art from the following detailed description of a preferred embodiment when considered in conjunction with the accompanying drawings.

DESCRIPTION OF THE PREFERRED EMBODIMENT

Figure 1B:
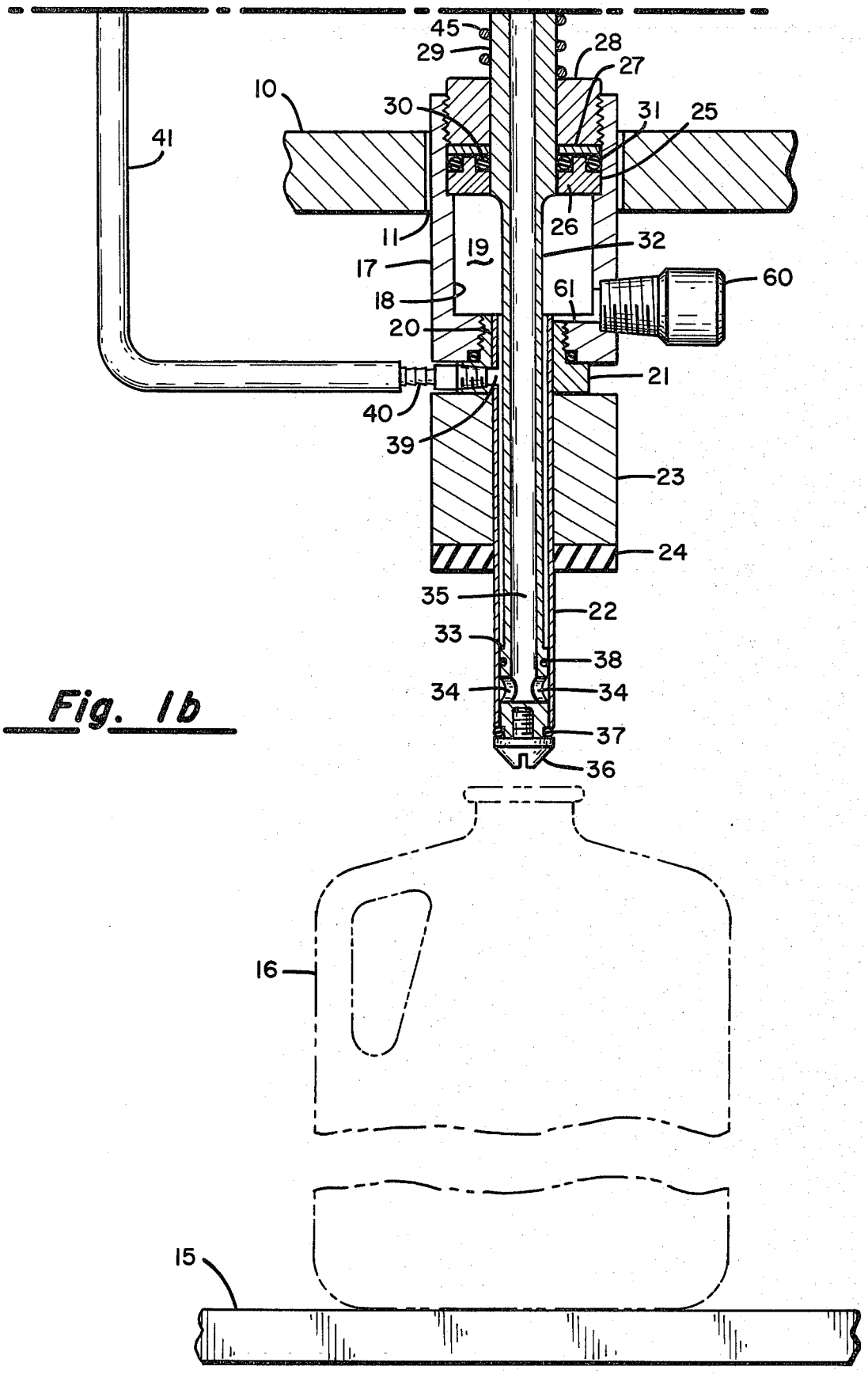
FIGS. 1, or 1(*a*) and 1(*b*) together illustrate a portion of the overall container filling machine with the liquid filling and level sensing valve being shown in cross-section to reveal its internal construction.

In a typical filling machine, containers will be received from a conveyor line and will be routed through the machine so that they can be filled to a predetermined level with a liquid or other product which flows like a liquid, e.g., a fine powder product. The present invention can be applied to filling machines of either the rotary type or the straight-line type. In the rotary-type filling mahine, the containers to be filled are conveyed by a moving belt to a first star wheel which functions to establish a predetermined spacing between adjacent containers while positioning them upon a rotating table in general alignment with a plurality of filling tubes. The product is entered into the containers as the table rotates and once filled, the containers are again removed from the table by a second rotating star wheel and are again deposited on a conveyor belt which may lead to the capping and labeling machinery.

In straight-line filling machines, the containers remain in a straight line as they pass through the machine. In an automatic version, the containers will be intermittently conveyed through the filler. In a semi-automatic straight-line machine, the containers are generally placed by hand under a row of filling valves, filled, then removed by hand, or, in some cases, conveyed out of the machine by an intermittently operating conveyor.

With this background in mind, there is illustrated in the drawing a single filling valve assembly incorporating the teachings of the present invention. It is to be understood that an automatic machine would typically include a plurality of identical filling valves at spaced apart locations in the frame of the machine. In a rotary filling machine, the framework would include a lower, generally circular plate 10 having a pattern of regularly spaced holes as at 11 formed therethrough at a given radius and a corresponding upper plate as as 12 also having an identical pattern of holes as at 13 formed through its thickness dimension. The holes 11 and 13 are vertically aligned so as to receive and constrain from lateral movement a plurality of filling valve assemblies which are indicated generally by numeral 14 in the drawing. The machine also includes a turntable 15 which receives the containers to be filled and transports them from the filling machine's input to its discharge point. A container 16 is shown in the drawing in a ghostline representation.

Before discussing the further details of operation, attention will be directed to the constructional features of the filling valve assembly 14. The valve includes a body member 17 which is preferably formed from stainless steel and which includes an axial bore 18 defining a cylindrical chamber 19.

A port is formed through the sidewall of the body member 17 and fitted into this port is a threaded fitting 60 which is adapted to be coupled to a drain hose leading either to a disposal point or back to the product supply tank. A groove 61 is formed in the base of the chamber 19 and leads to the drain port. This prevents puddling of foam or liquid in the chamber 17. A counterbore 20 is formed in the valve body 17 and is internally threaded so as to receive an externally threaded stud 21 therein. The stud 21 also has a concentric bore formed through it and sealingly secured within this bore is the proximal end of a first tubular member 22 which, for reasons which will become clear hereinbelow, may conveniently be referred to as the venting/level sensing tube. This tube projects downwardly from the base of the stud 21 for a predetermined distance, typically four inches. Disposed on the tube 22 is a spacer block 23, the height dimension of which is determined by the relative fill height within the container to be filled. On the underside of the spacer block 23 is a soft rubber gasket member 24 which serves as a seal for the finish on the container during operation of the filling apparatus.

Again referring to the body portion 17 of the valve, formed in its upper surface is a further counterbore 25 of a slightly larger diameter than the bore 18 so as to thereby define an annular shoulder or stop. Fitted within the counterbore 25 is a guide ring 26 which rests upon the annular shoulder. Located on top of the guide ring 26 is a washer 27 which is held in place within the valve body 17 by means of a threaded plug 28.

Extending through a bore formed in the threaded plug 28 is tubular piston 29 which is free to move in reciprocating fashion in that bore as a guide. The guide ring 26 includes an annular notch and disposed in that notch is an O-ring 30 which cooperates with the side wall of the tubular piston 29 to provide a liquid-tight seal therebetween. A further O-ring is disposed in another notch in the guide ring 26 to provide a seal between that guide and the inner side wall of the valve body 17. The tubular piston 29 includes an integrally formed product tube portion indicated by numeral 32. This product tube has an outer diameter dimensioned so as to provide a predetermined clearance fit between it and the inside wall of the venting and level sensing tube 22. As such, an annular passage is formed from the chamber 19 towards the distal end of the product tube.

The product tube flares out to a larger diameter at 33 near its lower end and formed through the side walls of the product tube in this zone of larger diameter are one or more ports as at 34 which communicate with the lumen 35 of the tubular piston.

Threaded into the distal end of the product tube is a screw 36 and a O-ring 37 is disposed about the shank of that screw so as to cooperate with the distal end portion of the outer tube 22 when the piston 29 is in its retracted position. A further O-ring 38 is disposed in an annular recess formed in the larger diameter portion of the product tube but on the opposite sides of the exit port 34 from the O-ring seal member 37. The 0-rings 37 and 38, then, create a barrier preventing the exit of liquids through the port 34 when the piston is in its retracted position.

The threaded stud 21 has a radial bore 39 formed laterally therethrough communicating with the annular passage defined by the clearance space between the outside diameter of the product tube portion 32 and the inside diameter of the venting/level sensing tube 22. A hose fitting 40 is inserted in the bore 39 permitting a length of tubing 41 to connect that bore to a fluidic logic and control unit 42. The unit 42 may comprise the Model 1017 D fluidic logic box manufactured and sold by Components Engineering Company of Fort Wayne, Indiana. That model is substantially similar in its construction to the logic module described in the Cox U.S. Pat. No. 3,905,404 mentioned in the introductory portion of this specification.

Formed at the proximal end of the tubular piston 29 is a male threaded fitting 43 having a nut 44 integrally formed therewith to facilitate connecting the filler tube assembly to a source of product. Disposed between the underside of the nut 44 and the upper surface of the threaded plug 28 is a compression spring 45 which is arranged to normally urge the product tube portion 32 of the tubular valve assembly into its retracted position relative to the outer tube 22. Surrounding the compression spring 45 is a pneumatic actuator indicated generally by numeral 46. It comprises an outer block 47 which may be cylindrical in shape and which has a longitudinal axial bore 47 formed therein for a predetermined distance in the underside thereof. A counterbore 48 is also formed in the block 47 so as to receive a tubular cylinder 49 therein. The tubular cylinder 49 is press fit within the bore 48 and being of a lesser diameter than the axial bore 47, defines an annular chamber 50 therebetween. Slidingly fitted within this annular chamber 50 is a cylindrical piston member 51 which is of a predetermined height dimension. A cup seal 55 surrounds the tubular cylinder 49 and is disposed atop the cylindrical piston 51 so as to provide an air-tight seal. A lateral bore 52 is formed through the side wall of the cylindrical block 47 so as to communicate with the annular chamber 50. A threaded fitting 53 is inserted in this lateral bore to facilitate a hose connection as at 54 between the fluid logic and control unit 42 and the pneumatic actuator 46.

The liquid product to be dispensed into the containers during the filling operation is fed through a tube 56 and through an elbow-shaped bore in a coupling block 57 which is arranged to be screwed onto the threaded fitting 43 integrally formed on the tubular piston 29.

Extending upwardly from the top surface of the coupling block 57 is a spout rod 58 which is of a predetermined length sufficient to reach a point proximate the upper guide plate 12. The spout rod 58 attaches to a weight 59, the weight being arranged to fit through the aperture 13 formed in the guide plate 12 so as to ensure true vertical reciprocal motion of the assembly during the filling operation. Not shown in the drawing is a cam which is arranged to cooperate with the filling valve assembly 14 to cause it to be cyclically raised and lowered relative to the guide plates 10 and 12 as the containers to be filled are routed past the filling nozzles.

Having described the details of the construction of the apparatus, consideration will now be given to its mode of operation.

OPERATION

As a container is brought into postion relative to the filling nozzle, the cam arrangement, not shown, lowers the filling valve assembly 14 with the distal end of the filling tube entering the container's opening. The cam continues to lower the assembly until the point is reached at which the soft rubber gasket 24 abuts the finish of the container 16, thereby sealing the container and preventing foam or the like from overflowing. At this point, the valve body 17 is totally supported by the container while the weight 59 acts upon the tubular piston 29 causing it to move downward against the force of the compression spring 45. In that the outer tube 22 is sealingly affixed relative to the valve body member 17, the product tube portion 32 of the filling valve will move downward until the bottom of the pneumatic actuator 46 abuts the upper surface of the threaded plug 28.

Because of the dimensioning involved, this will permit the end portion of the product tube 32 to extend out of the end of the venting/level sensing tube 22 and unblocking the product exit ports 34.

As a result, product from a supply tank (not shown) will be made to flow either by gravity or by pressure through the tube 56 and through the elbow bore formed in the coupling block 57 into the proximal end of the tubular piston 29. The liquid product flows downwardly through the product tube portion of the tubular piston and out the exit ports 34 to begin filling the container. As is the case with some products, the filling operation may cause foaming or frothing within the container. This foam is drawn up through the annular chamber defined by the spacing between the outside diameter of the product tube 32 and the inside diameter of the outer tube 22. The foam is drawn into the chamber 19 where it may exit through the port 60. As was mentioned earlier, the port 60 is at a lower level than the bottom surface of the chamber 19 by virtue of the groove 61 formed in that bottom surface, the groove leading to the exit port. Hence, there can be no liquid build-up within the chamber 19 surrounding the junction between the outer tube 22 and the bottom of the chamber 19 which otherwise may lead to erratic pressure sensing.

during this cycle, the fluidic logic and control unit 42 causes air under relatively low pressure to flow through the tube 41 and through the fitting 40 and from there down the annular passage between the concentric tubes 22 and 32 to the distal end of the tube 22.

As the level of product in the container rises, it ultimately reaches the distal end of the outer tube 22. When this occurs, a substantial change in back pressure is noted in the tube 41 leading to the fluid logic and control unit 42. This pressure change is sensed by the control unit 42 and it responds by directing air under high pressure through the tube 54 and the fitting 53 into the cylinder 50 of the pneumatic actuator 46. This pressurized air acts upon the cup seal 55 displacing it downwardly and, in doing so, the sleeve piston 51 is also moved downwardly to apply a separating force between the pneumatic actuator block and the housing 17. This separating force aids the force of the compression spring 45, thereby lifting the weight 59 and retracting the tip portion of the product tube 32 within the lumen of the venting/level sensing tube 22. The O-rings 37 and 38 cooperate with the inside wall surface of the outer tube 22 to preclude product from flowing beyond the seal points. The soft rubber gasket 24 continues to seal against the bottle finish, allowing foam to dissipate until the cam arrangement (not shown) reaches the point in its throw where the nozzle assembly 14 is lifted from the bottle. It is to be noted that the nozzle insertion-retraction cycle timing is independent of the filling and shut-off action. The filling, level sensing and shut-off actions are dependent on the insertion-retraction cycle only for opening the nozzle. Thus, if for some reason there is no bottle under the nozzle when it is lowered into the fill position, the product ports 34 remain closed and the system is ready for a subsequent cycle. The filling function is dependent upon the control circuit 42 only for the shut-off signal.

While in the drawings the product tube portion 32 of the tubular piston 29 and the venting/level sensing tube 22 are illustrated as having a circular cross-section, it is contemplated that square, oval or other cross-sectional shapes may be employed where dictated by the shape of the opening in the container to be filled.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modifications, both as to equipment details and operating procedures can be effected without departing from the scope of the invention itself.

What is claimed is:

1. Container filling apparatus comprising:

(a) a supply of fluid to be dispensed into said container;

(b) a pressure actuated filler and level sensing valve member characterized by:

(1) a body member having a longitudinal bore formed therein defining a chamber and a coaxial counterbore extending from said chamber through said body member, (2) a combination venting and pressure sensing tube of a predetermined length and inner dimension sealingly inserted through said counterbore, (3) a tubular piston extending coaxially through said chamber in said body member and having a product tube portion of an outer dimension less than said inner dimension of said venting and pressure sensing tube telescopingly received within said venting and pressure sensing tube to define an annular passage communicating with said chamber and extending between said venting and pressure sensing tube and said product tube portion, said product tube portion having at least one port formed through its side wall proximate its distal end, and (4) seal means disposed between the inside surface of said venting and pressure sensing tube and the outside surface of said product tube portion on opposite sides of said port when said tubular piston is retracted, (c) means coupling said supply of fluid to the lumen of said tubular piston;

(d) means including the container to be filled for extending said distal end of said product tube portion outwardly of the distal end of said venting and pressure sensing tube to unblock said port such that said fluid may flow from said supply through said tubular piston and said product tube portion;

(e) air pressure actuated control means coupled to said annular passage responsive to a predetermined change in pressure in said annular passage; and (f) means controlled by said control means for retracting said distal end of said product tube into said venting and pressure sensing tube to block said port when said predetermined change in air pressure in said annular passage is sensed.

2. The apparatus as in claim 1 and further including:

(a) an air/foam discharge port formed through said body member communicating with said chamber and said annular passage, said air/foam discharge port being at least partially below the intersection of said annular passage with said chamber.

3. The apparatus as in claim 2 and wherein air and foam is able to pass through said annular passage into said chamber as fluid flows through said port in said product tube into said container.

4. Apparatus as in claim 1 wherein said means controlled by said control means comprises:

(a) a pneumatic cylinder coaxially mounted on said tubular piston and having a further piston member disposed within said pneumatic cylinder for applying a force between said tubular piston and said body member tending to move said tubular piston to its retracted position.

5. Apparatus as in claim 4 and further including a compression spring disposed between said body member and said tubular piston to normally urge said tubular piston toward said retracted position.

6. Apparatus as in claim 5 and further including:

(a) a sealing member disposed about said vent tube for abutting the container's finish to provide a gas tight seal when said vent tube is inserted into said container to be filled; and (b) means applying a force on said tubular piston to force said sealing member against said container finish while extending said distal end of said product tube beyond the distal end of said venting and pressure sensing tube.

7. A pressure actuated filler and level sensing valve member comprising:

(a) a body member having a longitudinal bore formed therein defining a chamber and a coaxial counterbore extending from said chamber through said body member;

(b) a unitary venting and pressure sensing tube of a predetermined length and inner dimension having its proximal end sealingly inserted through said counterbore;

(c) a tubular piston extending coaxially through said chamber in said body member and having a product tube portion of an outer dimension less than said inner dimaeter of said unitary venting and pressure sensing tube telescopingly received within said venting and pressure sensing tube to define an annular passage communicating with said chamber and extending between said venting and pressure sensing tube and said product tube portion, said product tube portion having at least one port formed through its side wall proximate its distal end; and (d) seal means disposed between the inside surface of said venting and pressure sensing tube and the outside surface of said product tube portion on opposite sides of said port when said tubular piston is retracted within said venting and pressure sensing tube.

8. The pressure actuated filler and level sensing valve as in claim 7 and further including a pressure sensing port extending through the side wall of said venting and pressure sensing tube.

9. The valve as in claim 8 and further including actuator means operatively disposed between said tubular piston and said body member for selectively applying a separating force therebetween.

10. A pressure actuated filler and level sensing valve member as in claim 7 and further including:

(a) a sealing member disposed about said venting and pressure sensing tube for abutting the mouth of a container to be filled to provide a gas-tight seal when said venting and pressure sensing tube is inserted into said container to be filled; and (b) means for applying a force on said tubular piston to force said sealing member against the mouth of said container while extending said distal end of said product tube portion beyond the distal end of said venting and pressure sensing tube.

* * * * *